US010188201B1

(12) United States Patent
Schechter et al.

(10) Patent No.: US 10,188,201 B1
(45) Date of Patent: Jan. 29, 2019

(54) BROOM

(71) Applicant: Gordon Brush Mfg. Co. Inc., Commerce, CA (US)

(72) Inventors: Alan M. Schechter, Long Beach, CA (US); Kenneth L. Rakusin, Beverly Hills, CA (US)

(73) Assignee: GORDON BRUSH MFG. CO., INC., City of Industry, CA (US)

( * ) Notice: Subject to any disclaimer, the term of this patent is extended or adjusted under 35 U.S.C. 154(b) by 567 days.

(21) Appl. No.: 14/865,534

(22) Filed: Sep. 25, 2015

Related U.S. Application Data

(60) Provisional application No. 62/063,738, filed on Oct. 14, 2014.

(51) Int. Cl.

| | |
|---|---|
| ***A46B 15/00*** | (2006.01) |
| ***A46B 5/00*** | (2006.01) |
| ***B25G 3/38*** | (2006.01) |
| ***B25G 1/10*** | (2006.01) |

(52) U.S. Cl.
CPC ..... *A46B 5/0095* (2013.01); *B25G 1/10* (2013.01); *B25G 3/38* (2013.01)

(58) Field of Classification Search
CPC ..... B25G 1/10; B25G 3/38; A46B 5/0095
See application file for complete search history.

(56) References Cited

U.S. PATENT DOCUMENTS

| | | | | | |
|---|---|---|---|---|---|
| 1,256,565 | A * | 2/1918 | Inghram | A46B 5/0083 | 15/144.1 |
| 1,490,078 | A * | 4/1924 | Neff | A46B 3/00 | 15/194 |
| 4,597,204 | A * | 7/1986 | Heiden | E01H 5/02 | 15/144.1 |
| 4,882,802 | A * | 11/1989 | LeVere, Jr. | A46B 5/0054 | 15/144.1 |
| 8,739,348 | B1 * | 6/2014 | Currier | A46B 5/0075 | 15/159.1 |

OTHER PUBLICATIONS

"Bigger, Better Brush Ideas" Gordon Brush Product Catalog (2014), Gordon Brush Mfg. Co., Inc. 52 pages.
"Innovative Products that Clean better and Last Longer" Milwaukee Dustless Brush Catalog 2011. Gordon Brush Wisconsin, LLC. 40 pages.

* cited by examiner

*Primary Examiner* — Shay Karls
(74) *Attorney, Agent, or Firm* — Sandberg Phoenix & von Gontard, P.C.

(57) ABSTRACT

Briefly stated, a broom is provided that can be used to move, sweep, clean dirt, debris, water, or other matter. The broom comprises a head, a connector mounted to the head and a handle having one end mated to the connector and extending away from the head. The head comprises a rigid frame and a bristle package which is removably secured to or received in the frame. The frame thus provides structure and rigidity to the bristle package. The bristle package can have a length greater than, generally equal to, or shorter than a length of the frame.

27 Claims, 7 Drawing Sheets

BROOM

CROSS-REFERENCE TO RELATED APPLICATIONS

This application claims priority to U.S. App. No. 62/063,738 filed on Oct. 14, 2014 which is entitled "Broom." This application is also related to U.S. application Ser. No. 29/514,973 filed Jan. 19, 2015 which is entitled "Broom Head." Both of said applications are incorporated herein by reference.

STATEMENT REGARDING FEDERALLY SPONSORED RESEARCH OR DEVELOPMENT

Not Applicable.

BACKGROUND OF THE INVENTION

Brooms have been used for centuries to sweep caves, cabins and castles. Before 1797, brooms in America were hand-made. Tree branches and brush were often used to sweep the floor and clean the ashes from the fireplaces. Crude brooms were made by tying straw, hay, fine twigs or corn husks on a stick or handle. These crude brooms did not sweep well and fell apart after a short time, even though strong linen twine was often used.

Over time, the manner of producing brooms and brushes, and the materials from which broom and brushes are made evolved. Now brushes generally sweep well and have a long useful life. As the manufacturing processes evolved and the materials from which brooms and brushes were made evolved, people began developing brushes and brooms that met specific needs or were designed for specific purposes.

Despite the number of brooms and brushes in existence, there is still a need for brooms and brushes that fill certain niche requirements or needs. For example, it would be beneficial to provide an improved broom/brush for sweeping under seats and benches, for example, in theaters, arenas, stadiums, etc. In addition, it would be beneficial to provide a brush or broom in which the bristle package for the brush can easily be changed to, for example, replace a worn bristle package or change out the bristle package to adapt the broom frame for a different use.

SUMMARY

Briefly stated, a broom is provided that can be used to move, sweep, clean dirt, debris, water, or other matter. The broom comprises a head, a connector mounted to the head and a handle having one end mated to the connector and extending away from the head. The head comprises a rigid frame and a bristle package which is removably secured to or received in the frame. The frame thus provides structure and rigidity to the bristle package. The bristle package can have a length greater than, generally equal to, or shorter than a length of the frame.

The handle can be metal, wood, wood/steel, wood/metal, plastic, fiberglass, fiberglass/steel, fiberglass/metal, or coated, or any other desired material.

The broom frame can be made of aluminum, steel, metal, fiberglass, or plastic. Additionally, the broom frame can be straight or curved or straight with curved ends.

The bristles can be made from materials that are synthetic, metallic, derived from natural hair, or a combination of materials.

The connector can comprise a fixed socket or hinge-like socket that is fixed to the top of the frame. This hinge-like socket can be comprised of a generally U-shaped bracket member. To connect the handle to the socket member, the hinge-like socket can contain an orifice adapted to mate with an end of the handle, or the handle can define an orifice sized to receive a projection extending from the metal hinge-like socket. The hinged connector permits the head to pivot relative to the handle. This hinge-like socket changes direction according to whether the apparatus is pushed or pulled. The changing of direction enables the hinge-like socket and bristle material package to moves in concert to the direction to the apparatus being pushed or pulled, such that the bristle package remains in contact with the floor surface when the broom is switched between a pushing action and a pulling action. In addition, the hinge-like socket orients the bristle package in the opposite direction and perpendicular to the direction of the motion of the force when pushed or pulled, respectfully. The broom handle can be threadedly received in the hinge-like socket, or the broom handle and socket can be configured such that the broom handle receives the socket.

According to an aspect of the broom, the bristle package comprises at least one row of bristles and a bristle holder into which the bristles are fixed, and the frame has a lower surface defining an elongate channel which is sized and shaped complementarily to the bristle holder to slidably receive the bristle holder.

In one embodiment, the bristle holder comprises a block-like member having a lower surface and an upper surface, and the bristles extend from the lower surface. The bristle holder comprises a rib extending upwardly from the upper surface which is sized and shaped to be received in the channel of the frame. This rib can be shaped complimentarily to the frame channel. The lower surface of the bristle holder can define a plurality of holes formed in a desired pattern, and a bundle of bristles are secured in each the opening.

In accordance with an aspect of the frame, the frame can define a plurality of openings which intersect the channel of the bristle holder. In this embodiment, the brush including a plurality of fasteners which engage the bristle holder to removably hold the bristle holder in the frame. The frame openings can be threaded and can extend only to the bristle holder channel. In this instance, the fasteners are tightened against the bristle holder to securely frictionally hold the bristle holder in the channel. In an alternative, the frame openings extend through the channel, and the bristle holder includes a plurality of openings extending there through to define an opening first part which opens from a first surface of the frame and an opening second part. In the alternative, the openings of the bristle holder are positioned to be aligned with the openings of the frame when the bristle package is mounted to the frame. The fasteners then extend through the opening first part, through the openings of the bristle holder and into the opening second part. In this alternative, the fastener can be a pin and the opening second part can be sized and shaped relative to an end of the pin to frictionally hold the pin. In a variation, the frame opening first part is unthreaded and the frame opening second part is threaded. In this variation, the fastener can comprise a bolt or the like having a threaded end which threads into the frame opening second part. In another variation, the frame opening second part opens to a second surface opposite the first surface of the frame; and the fastener extends through the frame and the channel holder to extend beyond the second surface of the frame. In this variation, the fastener can comprise a cotter pin or a bolt.

In another alternative to prevent movement of the bristle head relative to the frame, the frame channel can be opened at least one end surface of the frame, and can include a closure to close the frame channel to prevent the bristle package from axially exiting the frame channel.

In another alternative to maintaining the bristle package in the frame channel relies on the complimentary shapes of the frame channel and the bristle package channel holder to define a friction fit which prevents the bristle package from being inadvertently removed from the frame in a direction generally perpendicular to an axis of the frame channel.

In another embodiment of the frame, the frame comprises a first frame member and a second frame member spaced from the first frame member; whereby at least a portion of the bristle holder can be received between the first and second frame members. In this embodiment, the frame further includes a plurality of fasteners selectively movable between a clamping position and an unclamping position; whereby when the fasteners are in the clamping position, the two frame members sandwich and hold the portion of the bristle package between the two frame members, and when the fasteners are in the unclamping position, the bristle package can be removed from, or inserted between, the frame members. The first frame member can be generally in the shape of an inverted L and define a front surface and a top surface, and the second frame member can be generally parallel to the front surface. The fasteners can be toggles or bolts.

In another alternative of the frame, the frame comprises a frame member having a plurality of openings extending therethrough, and the bristle holder includes a plurality of holes positioned to be aligned with the openings of the frame. In this embodiment, the broom further includes a plurality of fasteners which removably attach the bristle holder to the frame. In this instance, the frame member can be generally L-shaped and can be generally horizontally oriented to contact a top surface of the bristle holder or is generally vertically oriented to contact a front or back surface of the bristle holder. The holes of the bristle holder (through which the fasteners extend) can be formed in the top surface, the back surface or the front surface of the bristle holder.

The broom can be provided as a broom kit which comprises a handle, a frame mounted or mountable to an end of the handle and a plurality of bristle packages, wherein at least two of the bristle packages of the plurality of bristle packages are different from each other. The bristle packages can vary from each other in one or more of the following respects: bristle length, bristle material, bristle package length, front-to-back width of the bristle package. The kit would also include any necessary fasteners and tools required to secure a selected bristle package to the frame.

The bristle package can be provides as a replacement bristle package for a broom which can removably receive bristle packages. This replacement bristle package can include any of the above noted bristle packages. The replacement bristle package can be provided as a kit comprising at least one replacement bristle package, at least one fastener for securing the replacement bristle package in a broom frame and a tool for operating the fastener.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
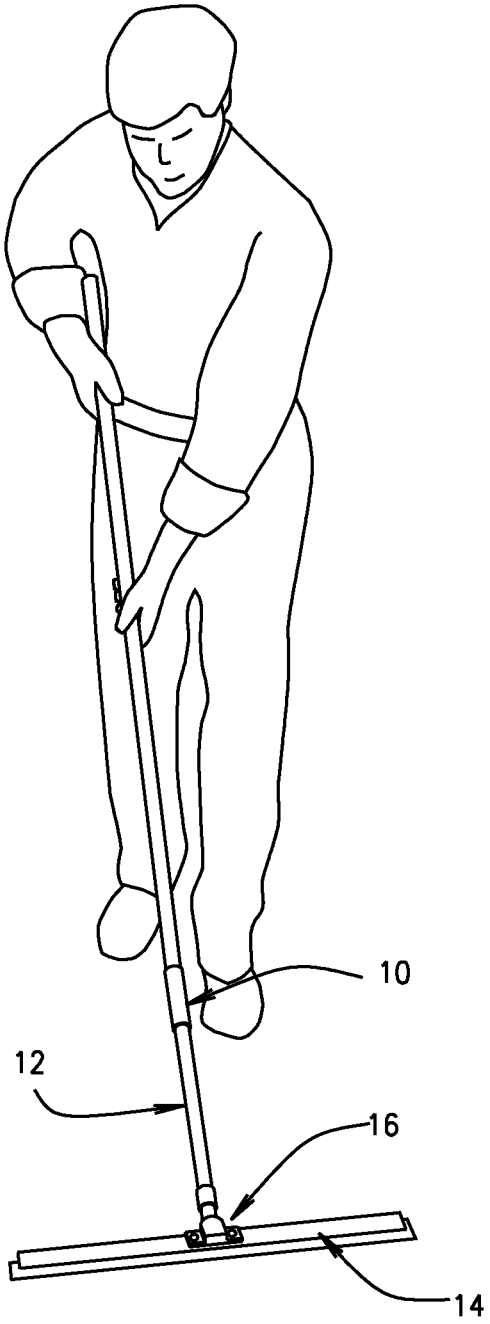
FIG. 1 is a perspective view of a broom/brush being used by a person.

The following detailed description illustrates the claimed invention by way of example and not by way of limitation. This description will clearly enable one skilled in the art to make and use the claimed invention, and describes several embodiments, adaptations, variations, alternatives and uses of the invention, including what we presently believe is the best mode of carrying out the claimed invention. Additionally, it is to be understood that the claimed invention is not limited in its application to the details of construction and the arrangements of components set forth in the following description or illustrated in the drawings. The claimed invention is capable of other embodiments and of being practiced or being carried out in various ways. Also, it is to be understood that the phraseology and terminology used herein is for the purpose of description and should not be regarded as limiting.

A broom 10 is shown generally in FIG. 1. The broom 10 comprises a handle 12 which can be grasped by a user, as seen in FIG. 1, to use the broom. The handle 12 is connected to a head assembly 14 by means of a connector 16 external of the head assembly. The handle can be made of any desired material. Illustratively, and without being limiting, the handle can be made of metal, wood, wood/steel, wood/metal, plastic, fiberglass, fiberglass/steel, fiberglass/metal, any other combination of wood, metal, plastic and fiberglass, or any of the foregoing and maybe coated.

The head assembly 14 comprises a bristle package 18 which is received in a frame 20. The bristle package 18 can comprise a single row of bristles 21 or multiple rows of bristles 21 which are secured in a bristle holder 24. As will be described below, both the bristle package 18 and the frame 20 can be formed in several different ways. Further, with slight modifications, any one of the bristle packages described below can be used with any of the frames described below.

Figure 3A:
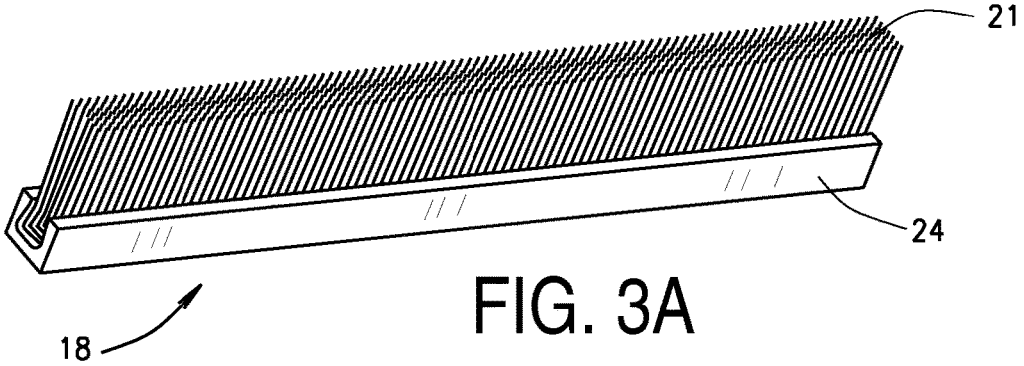
FIG. 3A is a perspective of an illustrative bristle package for use in the broom/brush.
Figure 3B:
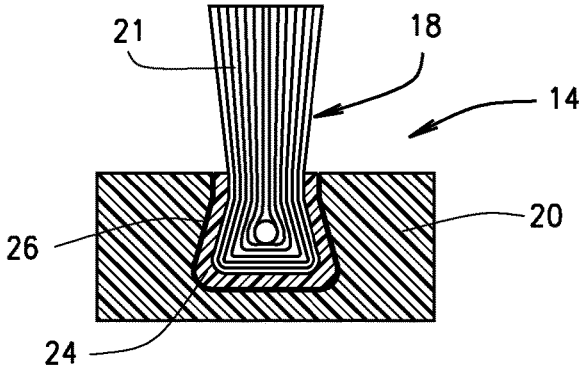
FIG. 3B is a cross-sectional view of the bristle package received in a brush/broom frame.

As seen in the end view of FIG. 3B, the bristle holder 24 is generally U-shaped with the sides of the "U" being angled or sloped toward each other. The bristles 21 extend from an open edge of the bristle holder 24. The bristles can be any desired length, and can be made from any desired material. For example, the bristles can be made from natural plant fibers, natural animal fibers (i.e., goat hair, hog hair, horse hair, etc.), metallic wire, synthetic material, or any desired combination thereof. As can be appreciated, regardless of the material from which the bristles are made, for any given material, the shorter the length of the bristle, the stiffer the bristle will be. The bristles 21 can be secured in the bristle holder 24 in any desired fashion. For example, the bristle holder 24 can effectively clamp the bristles in place or the bristles can be held in place with nuts and bolts. Alternatively, the bristles 21 can be glued, welded or bonded into the bristle holder 24. As can be seen, the bristle holder 24 with the bristles 21 defines a bristle package 18 that is relatively narrow. The bristle holder 24 can be made of metal, plastic, rubber or any other desired material. The bristle holder 24 can be rigid (so that it retains a desired shape, such as straight, curved, or straight with curving ends), or it can be flexible.

The frame 20 can, for example, comprise a block or strip, such as shown in FIG. 3B, which has a bottom surface defining a channel 26 sized and shaped to receive the bristle holder 24. The frame 20 can be made from any desired material which will withstand the use to which the brush is put. For example, the frame can be wood, metal (i.e., aluminum or steel), or plastic. Further, the frame can be coated, i.e., wood or metal with a plastic coating. The bristle holder 24 can be secured in the frame channel 26 by any desired means to secure the bristle package to the frame 20. For example, the bristle package can be secured with rivets which pass through the frame and bristle holder. Alternatively, bolts can pass through bolt holes 21*a,b* (FIGS. 6A-6C) in the frame and bristle holder, respectively, to removably secure the bristle holder, and thus the bristle package, in the frame 20. The bolts can extend into a threaded bore in the frame, or can extend through the frame to be secured with bolts. The bolt hole 21*a* in the frame can extend only from a front surface of the frame to open into the channel 26; it can extend beyond the channel, but not all the way through the frame; or it can extend all the way through the frame. In the first and last examples, the bolt hole could, first example, be threaded, such that the bolt can be threaded into the hole to removably secure bristle package to the frame. In this instance, the bolt would act in the manner of a set screw. In the second example, the second (blind) portion of the bolt hole could be threaded. In this instance, the bolts would pass through a portion of the bristle package which is received in the channel to be threadedly received in the second (blind) portion of the bolt hole. In this example, the bolt could be replaced with a pin which is frictionally received in the second (blind) portion of the hole. In this variation, the second portion of the hole would not need to be threaded. In the last example, the bolt would pass through the frame and the bristle package to extend out the opposite side of the frame. In this instance, the bolt would be secured, for example, with a nut. In this last example, the bolt could be replaced, for example, with a cotter pin. In yet another alternative, the bristle package can be glued into the frame channel 26. This would eliminate the need for fasteners and fastener holes, but would prevent the bristle package from being removed from the frame.

In the illustrative embodiment shown in FIG. 3B, the frame channel 26 and the bristle holder 24 are shaped complementarily to each other. Thus, the respective complementary shapes of the frame channel 26 and the bristle holder 24 will retain the bristle package 18 in the frame 20. That is, the bristle package cannot be pulled out of the frame channel 26 in a direction perpendicular to the frame channel 26. In this construction, the bristle package 18 can be slidably received in and removed from the frame channel 26. The ability to remove the bristle package from the frame allows for the bristle package to be replaced if its bristles becomes worn down, or to replace the current bristle package with a different bristle package which has bristles of a different length and/or material. The ability to switch out bristle packages allows for the broom/brush to be adapted for different uses. To prevent the bristle package from sliding out of the frame channel, bolts or pins can be used, as described above. Alternatively, the frame can include a gate or other closure at each end of the frame channel 26 which closes the frame channel. Alternatively, the frame channel can be open at only one side of the head, and the gate or closure can be provided at this single opened end. As a further alternative, the bristle holder 24 could be frictionally held in the channel 26, due, for example, to the relative size and shape of the bristle holder and channel and/or the configuration of the bristle holder and channel. That is, if the channel and bristle holder define an arc or curve, the curvature may help prevent the bristle package from moving relative to the frame. As a further alternative, fasteners (such as screws and/or bolts) can extend through the frame into the bristle holder, as described above, to removably secure the bristle package to the frame.

Figure 6A:
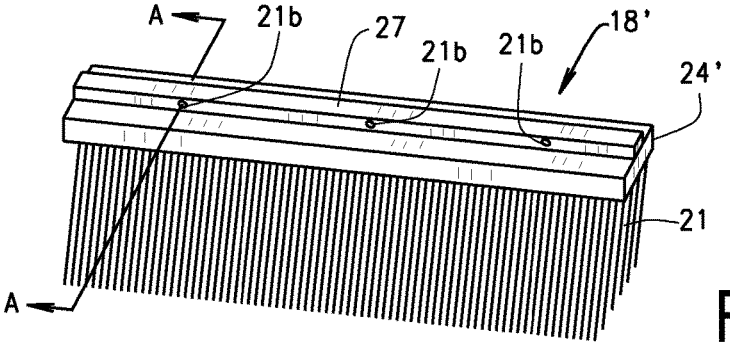
FIGS. 6A-6C comprise a perspective view of an alternative bristle assembly, a cross-section of the bristle assembly, and a cross-section of the bristle assembly received in a frame.
Figure 6B:
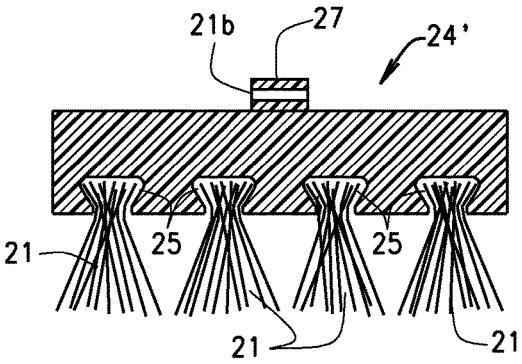
Figure 6C:
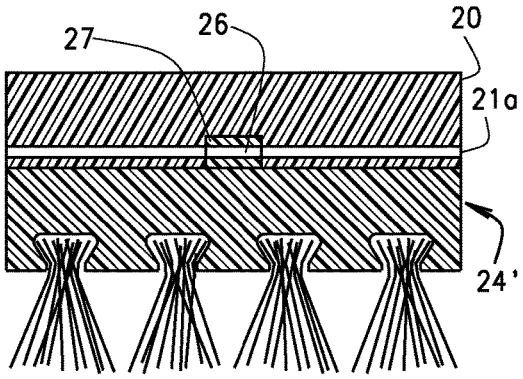

The bristle package 18 shown in FIGS. 3A and 3B has a single row of bristles. The bristle package could, alternatively, have multiple rows of bristles, for example, as shown in FIGS. 6A and 6B. In this instance, the bristle package 18' could comprise a bristle holder 24' in a desired shape, such as an elongate block. This block would have openings 25 formed in the bottom surface in a desired pattern, and bristles 21 would be secured in these openings. To secure the bristle package to the frame 20, the upper surface of the bristle holder could be provided with a rib 27 which is sized to be received in the channel 26 of the frame 20. This alternative bristle package 18' could be secured in the frame 20 just as described above (i.e., frictionally, or with pins, bolts, rivets, glue, etc.). This bristle holder can be formed from wood or plastic. In the latter instance, it could be molded. The bristles can be glued, stapled or anchored into the openings in the holder. If the holder is molded, the bristles could be molded into the holder, such that the bristles are embedded in the bristle holder.

Figure 7A:
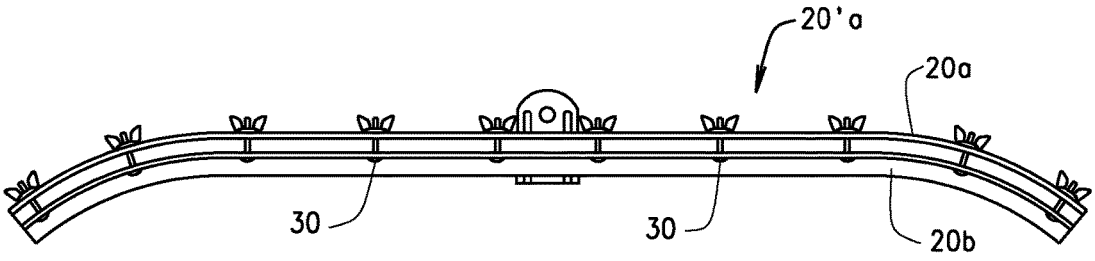
FIGS. 7A-7B are bottom plan and end elevational views of an alternative frame for the broom.
Figure 7B:
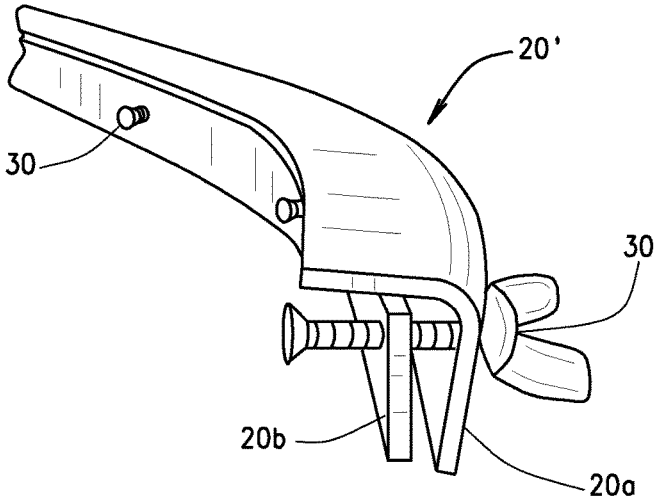

An alternative embodiment of a frame 20' is shown in FIGS. 7A-B. The frame 20' can comprise two members 20*a,b* which are secured together by a plurality of bolts. As seen in FIG. 7B, the frame member 20*a* is generally in the shape of an inverted L, and the frame member 20*b* is a vertical member which is generally parallel the front leg of the frame member 20*a*. Fasteners 30, such as bolts, can be tightened to a clamping position to pull the two frame members together to clamp the bristle package 18 (such as the bristle package shown in FIG. 3A) between the two members. The bolts can be loosened to an unclamping position to allow for the bristle package to be inserted between or removed from between the frame members. The bolts can be replaced, for example, with toggles. This construction provides for a slim or narrow frame which allows for the bristle package to be easily secured to and removed from the frame. This frame 20' can be used with the bristle holder 24', and the bolts can extend through the bolt holes 21*b* in the rib 27 of the bristle holder 24'. In an alternative, the bristle holder 24' could be formed without the rib 27, in which case, the holes 21*b* extend through the block or body of the bristle holder. In a variation of the frame 20', the frame 20' could be provided without the second, or back, frame member 20*b*. In this instance, the fastener (bolt or screw) would pass through the first, or front, frame member 20*b* and into the rib 27 or body of the bristle holder (if provided without a rib). In this one-member variation of the frame 20', the frame member can be generally L-shaped, as shown in FIG. 7B. Alternatively, the frame member can be a generally vertical member (which is placed adjacent a front or back surface of the bristle package bristle holder) or a generally horizontal member (which is positioned above the bristle package bristle holder).

Figure 2A:
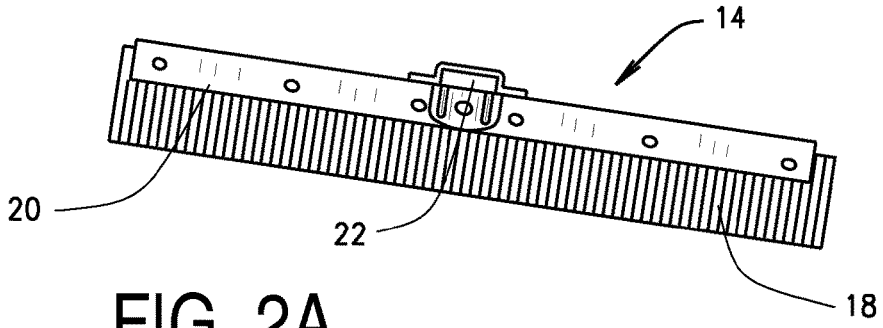
FIGS. 2A and 2B are perspective views of straight and curved head assemblies, respectively, for the broom/brush.
Figure 2B:
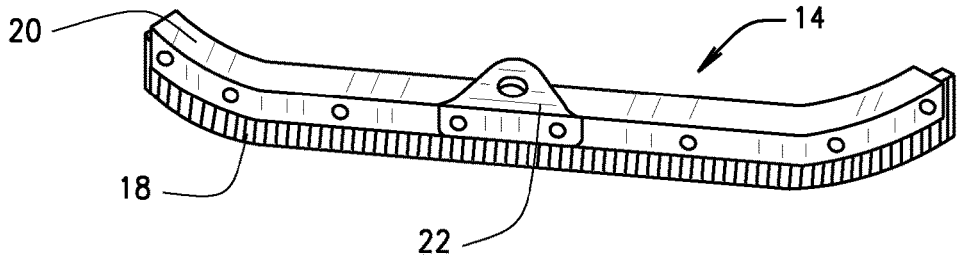

The head assembly 14 can be any desired shape. It can be straight, as shown in FIG. 2A, or it can be curved, as seen in FIG. 2B. Further, the bristle package can be shorter than, as long as, or longer than the frame. Thus, the frame can extend beyond the ends of the bristle package; the bristle package can extend beyond the ends of the frame; or the ends of the frame and bristle package can be even with each other.

Figure 4A:
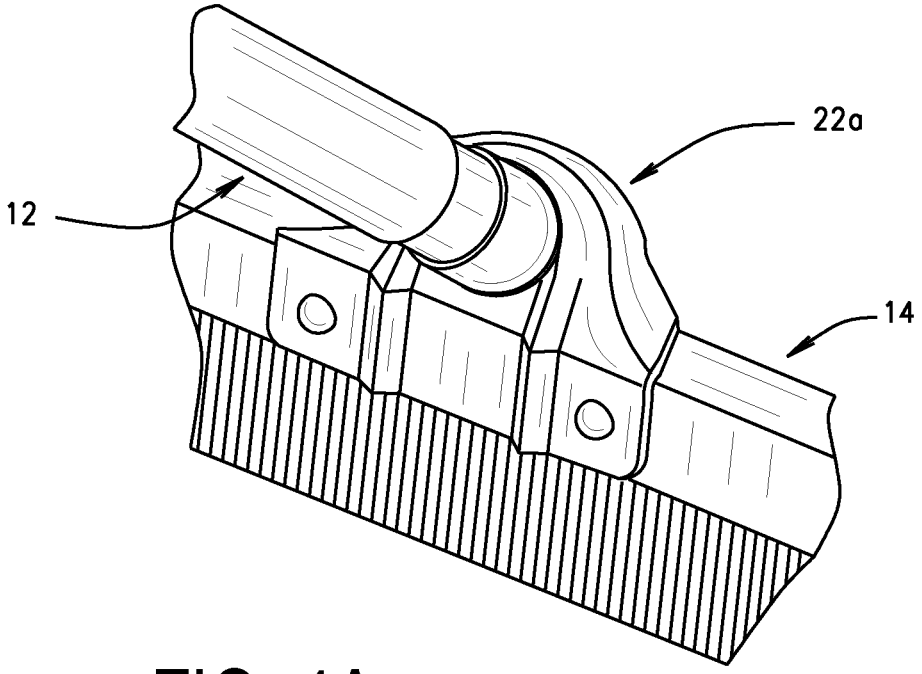
FIGS. 4A and 4B are perspective views of fixed and hinged-type connectors, respectively, secured to a broom head.
Figure 8:
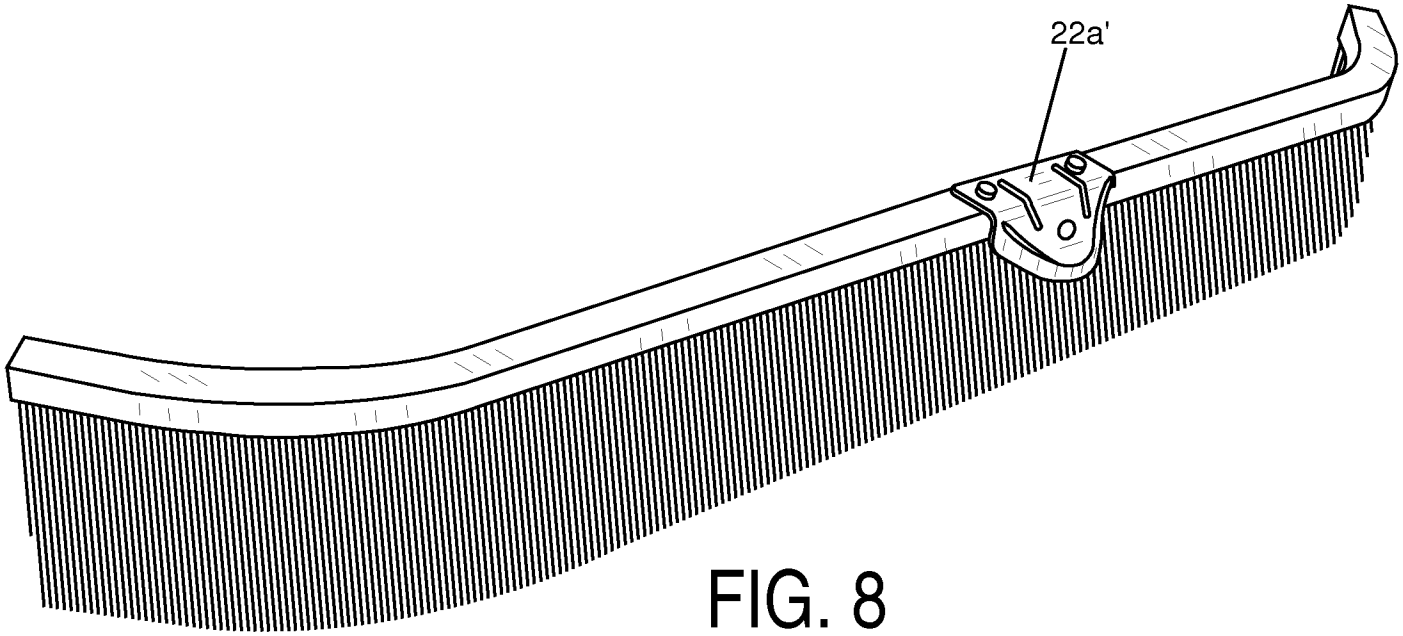
FIG. 8 is a perspective view of the broom head with a stationary (non-pivoting) connector.

The handle 12 is secured to the frame 20 of the head assembly 14 by any desired means. In one example, the handle can be secured to the head assembly by means of a connector 22 which is secured to the frame 20. The connector can be a fixed connector 22*a* or 22*a'*, such as is shown in FIGS. 4A and 8, which positionally fixes the handle 12 and frame 20 together, such that one does not move relative to the other. The fixed connector 22*a*, 22*a'* are threadedly connected. For example, the connectors 22*a*, 22*a'* can include an internally opening which receives an externally threaded end of the handle 12. Alternatively, the handle could have an internally threaded opening in its end which receives an externally threaded post on the connector. In either instance, the handle could be removed from the head to allow for either the head or the handle of the broom 10 to be replaced. In another alternative, the connector can include an opening which frictionally receives the handle, and to which the handle is secured, for example, by means of a fastener (such as a screw, bolt or nail). In this instance, the handle is not removable from the connector without removing the fastener.

Figure 4B:
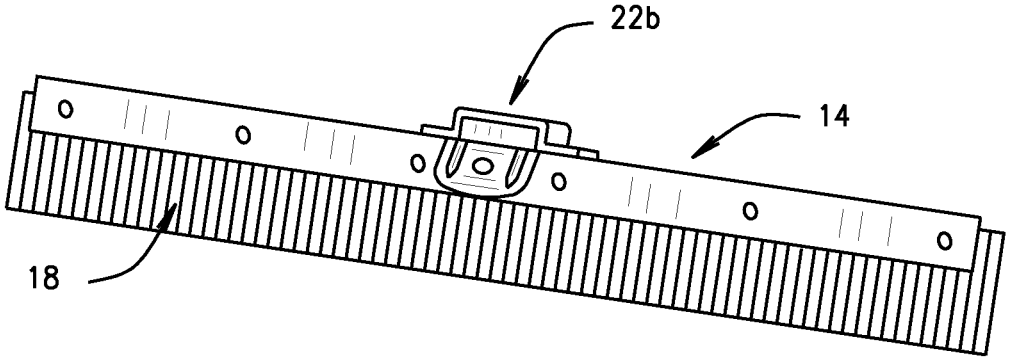
Figure 5B:
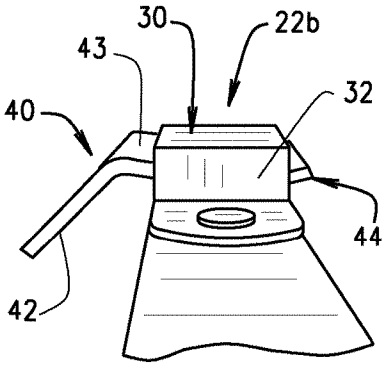
FIGS. 5A and 5B are side views of the hinged-type connector showing a tongue of the connector in first (FIG. 5A) and second (FIG. 5B) positions relative to a frame of the brush/broom.
Figure 5D:
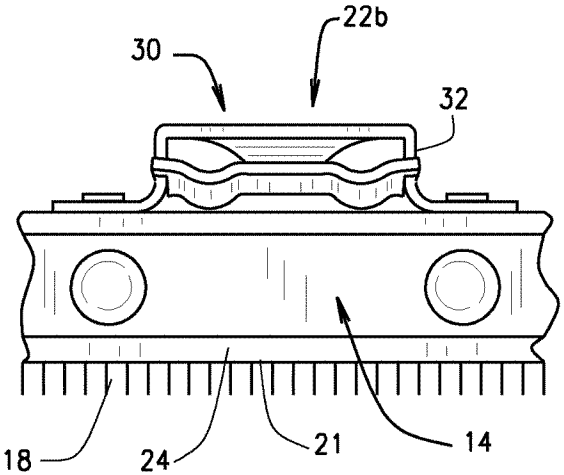
FIGS. 5C and 5D are end views of the hinged-type connector showing a tongue of the connector in first (FIG. 5C) and second (FIG. 5D) positions relative to a frame of the brush/broom.
Figure 5A:
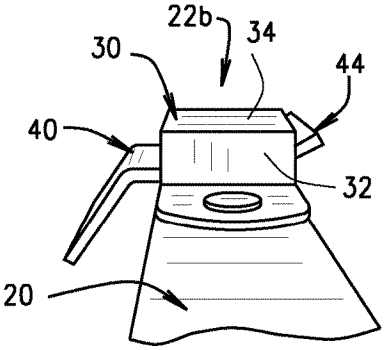
Figure 5C:
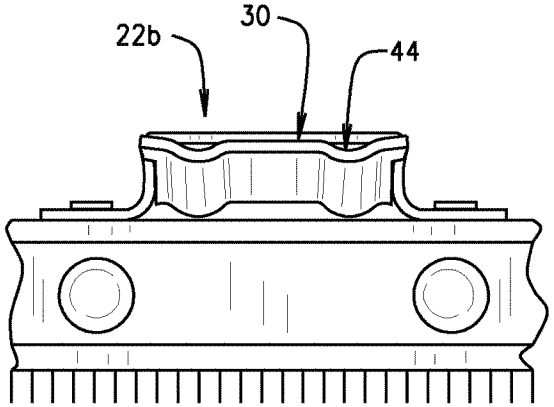
Figure 5E:
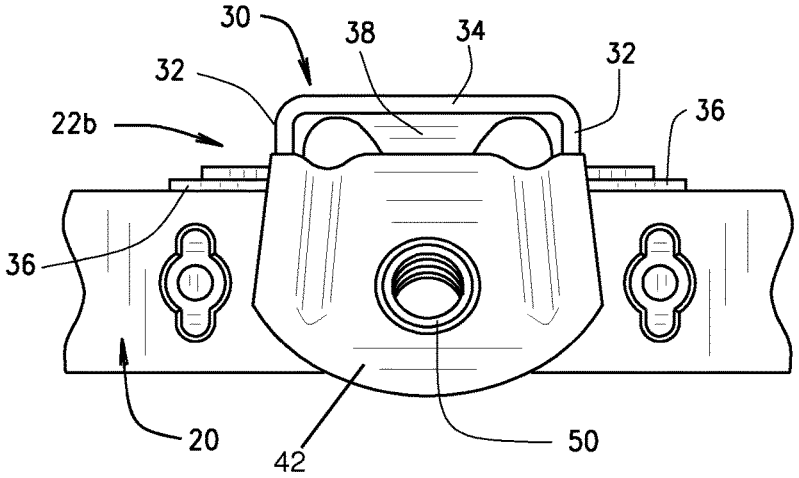
FIG. 5E is a top plan view of the hinged-type connector.

An alternate hinged-type connector 22*b* is shown in FIG. 4B and in more detail in FIGS. 5A-E. This hinged-type connector 22*b* allows the frame 20, and thus the head 14, to pivot relative to the handle about an axis generally parallel to the head 14. The connector 22*b* includes a bracket 30 which is secured to the frame 20, for example, by means of fasteners, such as rivets. The bracket 30 is generally U-shaped, and has side walls 32 and a top wall 34. Wings 36 extend from the bottom of the side walls 32, and the fasteners extend through the wings to secure the bracket 30 to the frame 20. A cone 38 (FIG. 5E) with a curved or rounded apex extends inwardly from the bracket top surface 34.

A pivot member 40 is received in the bracket. The pivot member 40 comprises a first portion 42 to which the handle 12 is secured, a second portion 43 which extends from the first portion and into the bracket 30. The first and second portions 42, 43 are angled relative to each other. A third portion 44 extends from the second portion 43 at an angle and in a direction opposite of the direction of the first portion 42. Thus, with respect to FIGS. 5A, B, the pivot member first portion 42 (as shown in the drawing) is facing generally downwardly and the third portion 44 is angled generally upwardly. The second and third portions 42, 43 define an angle or apex (not shown) which is positioned between the apex of the cone 38 and the top surface of the frame 14. The handle 12 is secured to the first portion 42, and first portion can be provided with an orifice 50 or hole which receives an end of the handle. The orifice can, for example, be internally threaded, and the handle can be screwed into the connector orifice. Conversely, the orifice can be replaced with an externally threaded post, and the handle can be provided with an internally threaded orifice, such that the handle is screwed onto the connector post.

As can be appreciated, the pivot member 40 and the frame 20 can move relative to each other, with one pivoting relative to the other about the cone 38. The cone 38 thus effectively forms/defines a fulcrum. This pivoting action defines a hinging action which enables the frame (and hence the bristle package) to change direction when the motion of the brush/broom is switched between a pulling motion and a pushing motion. This allows for the connector and the bristle package to move in concert to the direction to the apparatus being pushed or pulled. Specifically, the connector orients the bristle package in the opposite direction of and perpendicular to the direction of the motion of the force when pushed or pulled, respectfully. Due to the action of the hinge-like connector 22*b*, the bristle package remains in contact with the floor surface when the broom/brush is switched between a pushing action and a pulling action.

As can also be appreciated, the frame and bristle package provides for a system in which the bristle package can be easily removed from the frame. Several different frames and bristle packages have been described. As can be appreciated, with slight variations to either the frame or the bristle package, any of the described bristle packages can be secured to any of the described frames. The ability to replace bristle packages will allow a worn bristle package to be replaced with a new bristle package, or a bristle package adapted for one use to be replaced with a bristle package adapted for a different use. With respect to this last mentioned ability, a broom can be provided as a kit which includes the handle, frame, and two or more bristle packages, wherein each of the different bristle packages is adapted for a different use. Thus, one bristle package will have one or more parameters which differ from at least one other bristle package in the kit. These parameters include, for example, bristle length, bristle material, number of bristles supported by the bristle holder (i.e., single row vs. multi row bristle package), and bristle holder length. If desired, the kit could contain two or more of a specific type of bristle package and only one of other types of bristle packages, to provide for replacement of bristle packages which are used more frequently (and thus are worn out more quickly) than other bristle packages.

Further, these replaceable bristle packages can be made available independently of the broom handle and frame, such that a consumer can simply buy replacement bristle packages. These replacement bristle packages can be made available individually or as a plurality of bristle packages. In the latter event, the bristle packages in the plurality of bristle packages can all be the same, or the plurality of bristle packages can present an assortment of types of bristle packages. In either instance, the replacement bristle packages can be provided as a bristle package kit. That is, the bristle package can be supplied with any necessary fastener (such as a bolt and nut) and any necessary tools (such as a wrench or Allen screw driver).

As various changes could be made in the above constructions without departing from the scope of the invention, it is intended that all matter contained in the above description or shown in the accompanying drawings shall be interpreted as illustrative and not in a limiting sense.

The invention claimed is:

1. A broom that can be used to move, sweep, clean dirt, debris, water, or other matter, comprising: a rigid head, a connector mounted to the head and a handle having one end mated to the connector and extending away from the head, and bristles extending from a bottom surface of said head; the head having a generally straight central section and opposite end portions angled relative to said central section, such that said head is generally curved in a horizontal plane;

said head further comprising a rigid frame; said bristles being contained in a bristle package comprising a bristle holder from which said bristles extend; said bristle package being removably secure to the frame.

2. The broom according to claim 1 wherein the frame is made of aluminum, steel, metal, fiberglass, or plastic.

3. The broom according to claim 1 wherein the bristles are synthetic, plastic, metallic, derived from natural hair, or a combination of materials.

4. The broom of claim 1 wherein the connector comprises a hinge-like socket that is fixed to the top of the head, the connector permitting the head to pivot relative to the handle.

5. The broom according to claim 4 wherein the hinge-like socket is comprised of a generally U-shaped bracket member.

6. The broom according to claim 5 wherein the hinge-like socket contains an orifice adapted to mate with an end of the handle, or wherein the handle defines an orifice sized to receive a projection extending from the metal hinge-like socket.

7. The broom according to claim 6 wherein one of the handle and hinge-like socket threadedly receives the other of the handle and hinge-like socket.

8. The broom according to claim 4 wherein the hinge-like socket changes direction according to whether the apparatus is pushed or pulled.

9. The broom according to claim 4 wherein the hinge-like socket and bristle material package moves in concert to the direction to the apparatus being pushed or pulled, such that the bristle package remains in contact with the floor surface when the broom is switched between a pushing action and a pulling action.

10. The broom according to claim 9 wherein the hinge-like socket orients the bristle package in the opposite direction and perpendicular to the direction of the motion of the force when pushed or pulled, respectfully.

11. The brush according to claim 1 wherein the bristle package comprises at least one row of bristles and a bristle holder into which the bristles are fixed; said frame having a lower surface defining an elongate channel sized and shaped complementarily to said bristle holder to slidably receive the bristle holder.

12. The brush according to claim 11 wherein said bristle holder comprises a block-like member having a lower surface and an upper surface; said bristles extending from said lower surface; said holder comprising a rib extending upwardly from said upper surface; said rib being sized and shaped to be received in said channel of said frame.

13. The brush according to claim 12 wherein said bristle holder lower surface defines a plurality of holes formed in a desired pattern; a bundle of bristles being secured in each said opening.

14. The brush according to claim 12 wherein said rib is shaped complimentarily to said frame channel.

15. The brush according to claim 11 wherein said frame defines a plurality of horizontally extending openings which intersect said channel; said brush including a plurality of fasteners which engage said bristle holder to removably hold said bristle holder in said frame.

16. The brush according to claim 15 wherein said frame openings are threaded and extend only to said channel, and said fasteners are tightened against said bristle holder to securely frictionally hold said bristle holder in said channel.

17. The brush according to claim 15 wherein said frame openings extend through said channel and wherein said bristle holder includes a plurality of openings extending therethrough to define an opening first part which opens from a first surface of said frame and an opening second part; the openings of said bristle holder being positioned to be aligned with the openings of said frame when said bristle package is mounted to said frame; said fasteners extending through said opening first part, through said openings of the bristle holder and into said opening second part.

18. The brush according to claim 17 wherein said fastener is a pin; said opening second part being sized and shaped relative to an end of said pin to frictionally hold said pin.

19. The brush according to claim 17 wherein said frame opening first part is unthreaded and said frame opening second part is threaded; said fastener comprising a bolt having a threaded end which threads into the frame opening second part.

20. The brush according to claim 17 wherein the frame opening second part opens to a second surface opposite said first surface of said frame; said fastener extending through said frame and said channel holder to extend beyond the second surface of said frame.

21. The brush according to claim 17 wherein the fastener comprises one of a cotter pin or a bolt.

22. The broom according to claim 11 wherein said frame channel is opened at least one end surface of said frame; said frame including a closure to close said frame channel to prevent said bristle package from axially exiting said frame channel.

23. The broom according to claim 11 wherein the complimentary shapes of the frame channel and the bristle package channel holder define a friction fit which prevent said bristle package from being inadvertently removed from said frame in a direction generally perpendicular to an axis of said frame channel.

24. The broom of claim 15 wherein said frame comprises a first frame member and a second frame member spaced from and separate from said first frame member; whereby at least a portion of said bristle holder can be received between said first and second frame members; said fasteners being selectively movable between a clamping position and an unclamping position; whereby when said fasteners are in said clamping position, said two frame members sandwich and hold said portion of said bristle package there between, and when said fasteners are in said unclamping position, said bristle package can be removed from, or inserted between, said frame members.

25. The broom of claim 24 wherein said first frame member is generally in the shape of an inverted L and defines a front surface and a top surface, and wherein said second frame member is generally parallel to said front surface.

26. The broom of claim 25 wherein said plurality of fasteners comprises toggles or bolts.

27. The broom of claim 1 wherein said frame comprises a frame member having a plurality of openings extending therethrough; said bristle holder including a plurality of holes positioned to be aligned with the openings of said frame; said broom further including a plurality of fasteners which removably attach said bristle holder to said frame;

wherein, said frame member is generally L-shaped, is generally horizontally oriented to contact a top surface of said bristle holder or is generally vertically oriented to contact a front or back surface of said bristle holder; and wherein the holes of the bristle holder are formed in the top surface, the back surface or the front surface of said bristle holder.

* * * * *